US011116328B2

(12) United States Patent
Franco

(10) Patent No.: US 11,116,328 B2
(45) Date of Patent: Sep. 14, 2021

(54) MATTRESS COVER

(71) Applicant: Franco Importing Pty Ltd., Cobbitty (AU)

(72) Inventor: Luigi Anthony Franco, Cobbitty (AU)

(73) Assignee: Franco Importing Pty. Ltd., Cobbitty (AU)

( * ) Notice: Subject to any disclaimer, the term of this patent is extended or adjusted under 35 U.S.C. 154(b) by 0 days.

(21) Appl. No.: 16/773,617

(22) Filed: Jan. 27, 2020

(65) Prior Publication Data

US 2021/0227993 A1 Jul. 29, 2021

(51) Int. Cl.
*A47C 31/10* (2006.01)
*A47C 31/08* (2006.01)

(52) U.S. Cl.
CPC ..... *A47C 31/105* (2013.01); *A47C 31/08* (2013.01)

(58) Field of Classification Search
CPC ..... A47C 31/105; A47C 31/08; B65G 7/12; B65D 33/06; A45C 13/002; D10B 2505/10
See application file for complete search history.

(56) References Cited

U.S. PATENT DOCUMENTS 2,982,977 A * 5/1961 Caster ..... A47C 31/08 5/703

OTHER PUBLICATIONS

Nordic Elk, Reusable Mattress Bag, Sep. 5, 2019, nordicelk.com (retrieved from https://web.archive.org/web/20190905211113/http://nordicelk.com/1075-2/) (Year: 2019).*

* cited by examiner

*Primary Examiner* — Eric J Kurilla
(74) *Attorney, Agent, or Firm* — Eric Karich; Karich & Associates

(57) ABSTRACT

A mattress cover for covering and carrying a mattress has a rectangular cuboid mattress cover body sized to fit around and contain the mattress, and includes a handle strap mounted on an outer surface of the mattress cover body for facilitating lifting of the mattress cover. An additional handle strap is mounted on an inner surface of the mattress cover body, the additional handle strap having the same structure as the handle strap, wherein the first, second, and third attachment points of the handle strap and the first, second, and third attachment points of the additional handle strap are fastened together with first, second, and third fasteners, respectively, to sandwich the rectangular cuboid mattress cover body therebetween.

1 Claim, 2 Drawing Sheets

MATTRESS COVER

BACKGROUND OF THE INVENTION

Field of the Invention

This invention relates generally to mattress covers, and more particularly to a mattress cover with an improved handle strap construction.

Description of Related Art

Mattress covers having handles to facilitate carrying a mattress are known in the art. Such mattress covers typically have a strap sewn to the mattress cover which provides handles for more easily grasping the cover for lifting the mattress.

The prior art does not teach, however, mattress covers which are reversible and include handle straps on both the inside and outside surfaces. The prior art also does not teach these inner and outer straps being sewn to each other, to sandwich the mattress cover therebetween. The present invention fulfills these needs and provides further advantages as described in the following summary.

SUMMARY OF THE INVENTION

The present invention teaches certain benefits in construction and use which give rise to the objectives described below.

The present invention provides a mattress cover for covering and carrying a mattress, the mattress cover comprising a rectangular cuboid mattress cover body adapted, sized, and shaped to fit around and contain the mattress, the cuboid mattress cover body having an inner surface and an outer surface. The mattress cover further includes a handle strap mounted on the outer surface of the rectangular cuboid mattress cover body for facilitating lifting of the mattress cover, the handle strap having first, second, and third attachment points. The first attachment point is at a first end of the handle strap, the second attachment point is at a middle of the handle strap, and the third attachment point is at a second end of the handle strap, thereby forming a first handle portion between the first and second attachment points, and forming a second handle portion between the second and third attachment points. An additional handle strap is mounted on the inner surface of the rectangular cuboid mattress cover body, the additional handle strap having the same structure as the handle strap, wherein the first, second, and third attachment points of the handle strap and the first, second, and third attachment points of the additional handle strap are fastened together with first, second, and third fasteners to sandwich the rectangular cuboid mattress cover body therebetween.

A primary objective of the present invention is to provide a mattress cover having advantages not taught by the prior art.

Another objective is to provide a mattress cover which has handle straps on both inner and outer surfaces for facilitating carrying of a mattress.

A further objective is to provide a reversible mattress cover wherein the handle straps are sewn together to sandwich the mattress cover therebetween.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a mattress cover 10 for covering and carrying a mattress 12.

Figure 1:
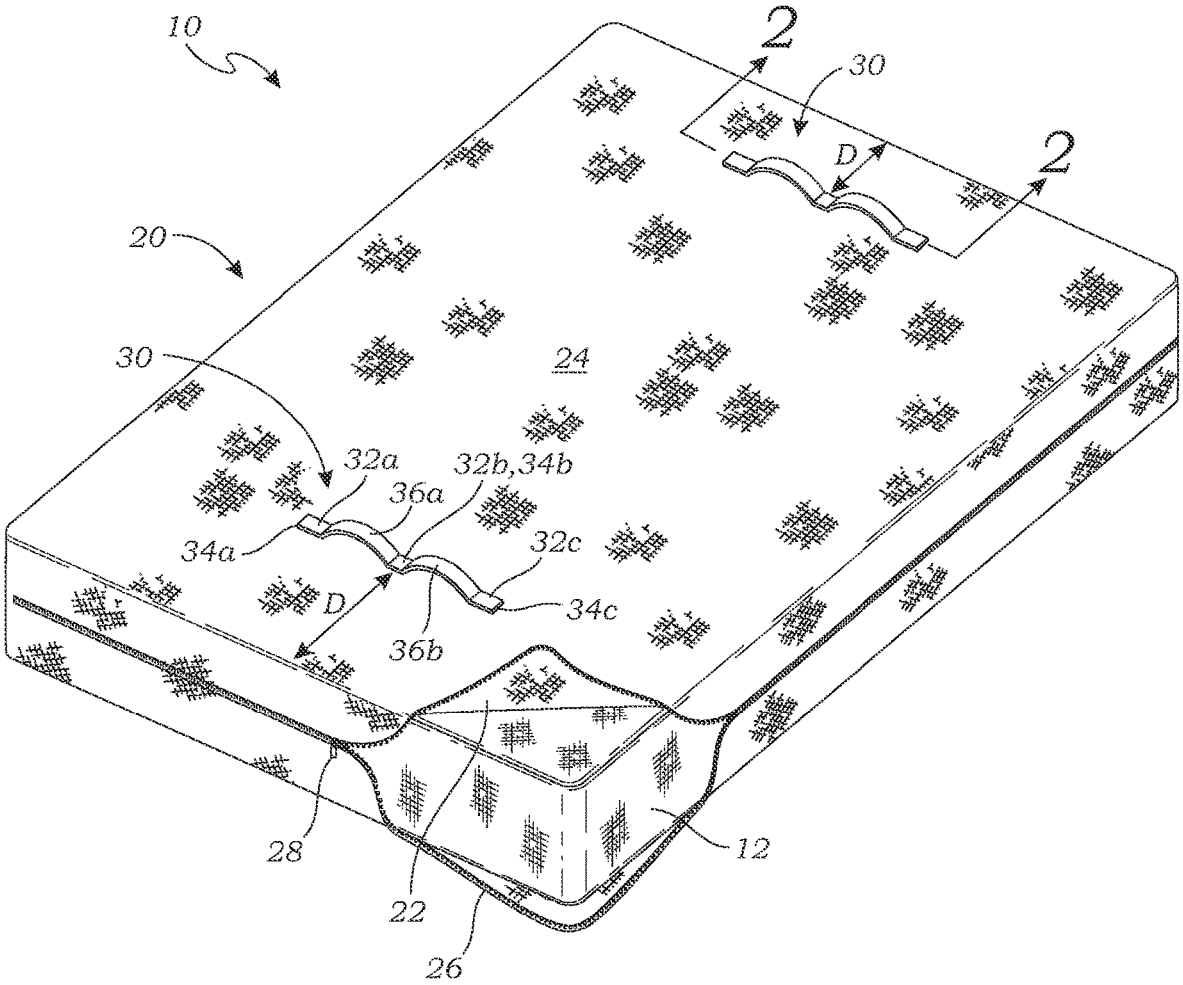
FIG. 1 is a perspective view of a mattress cover according to a first embodiment of the present invention.

FIG. 1 is a perspective view of the mattress cover 10 according to a first embodiment of the present invention. As shown in FIG. 1, the mattress cover 10 comprises a cuboid mattress cover body 20 that is adapted, sized, and shaped to fit around and contain the mattress 12. The cuboid mattress cover body 20 has an inner surface 22 and an outer surface 24, and extends to an opening 26 that is closable with a fastener 28 (e.g., zipper, hooks and loops fasteners, etc.). The cuboid mattress cover body 20 may be constructed of any suitable material known in the art for these types of covers (i.e., tarpaulin, cotton, canvas, polyester, or similar material known in the art). Since the general construction of the cuboid mattress cover body 20 is known in the art, it is not described in greater detail herein.

A handle strap 30 is mounted on the outer surface 24 of the mattress cover body 20 for facilitating lifting of the mattress cover 10, the handle strap 30 having first, second, and third attachment points 32*a*, 32*b*, and 32*c*, respectively. The first attachment point 32*a* is at a first end 34*a* of the handle strap 30, the second attachment point 32*b* is at a middle 34*b* of the handle strap 30, and the third attachment point 32*c* is at a second end 34*c* of the handle strap 30, thereby forming a first handle portion 36*a* between the first and second attachment points 32*a* and 32*b*, and forming a second handle portion 36*b* between the second and third attachment points 32*b* and 32*c*. While a single handle strap 30 is mentioned and described in detail, it is expected that the mattress cover 10 will typically include at least two of these straps, one at each end, and another pair may be located on the other side of the mattress cover body 20.

In this embodiment, there are two handle straps 30, one at each end of the cuboid mattress cover body 20. Each of the handle straps 30 is positioned to extend laterally across the cuboid mattress cover body 20, spaced a distance D from each of the ends of the cuboid mattress cover body 20.

Figure 2:
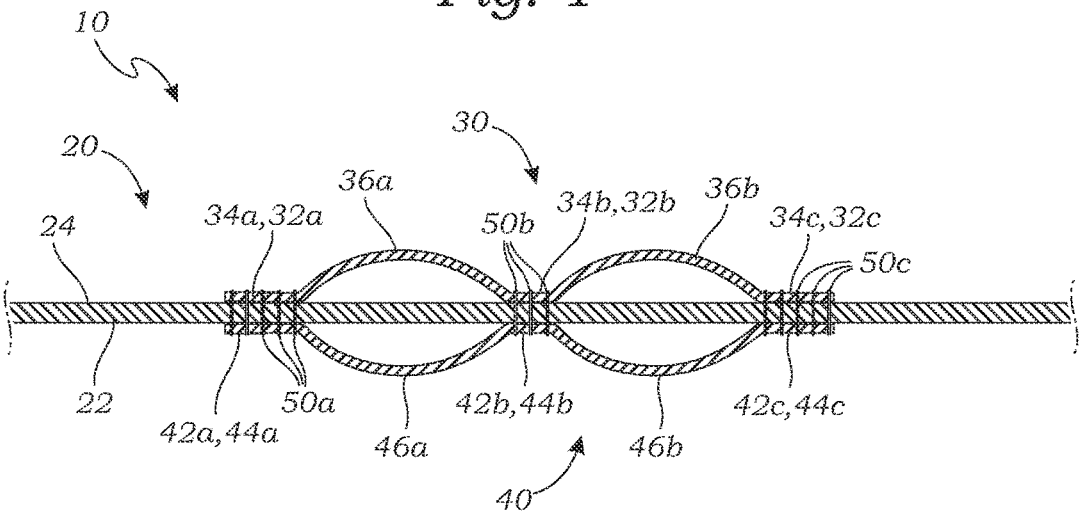
FIG. 2 is a sectional view thereof taken along line 2-2 in FIG. 1.

FIG. 2 is a sectional view of the mattress cover 10 taken along line 2-2 in FIG. 1. As illustrated in FIG. 2, an additional handle strap 40 may be mounted on the inner surface 22 of the mattress cover body 20, the additional handle strap 40 having first, second, and third attachment points 42*a*, 42*b*, and 42*c*, respectively. As described above, the first attachment point 42*a* is at a first end 44*a* of the additional handle strap 40, the second attachment point 42*b* is at a middle 44*b* of the additional handle strap, and the third attachment point 42*c* is at a second end 44*c* of the additional handle strap 40, thereby forming an additional first handle portion 46*a* between the first and second attachment points 42*a* and 42*b*, and forming an additional second handle portion 46*b* between the second and third attachment points 42*b* and 42*c*.

The first, second, and third attachment points 32*a*, 32*b*, and 32*c* of the handle strap 30 are fastened together with the first, second, and third attachment points 42*a*, 42*b*, and 42*c* of the additional handle strap 40 with first, second, and third fasteners 50*a*, 50*b*, and 50*c*, respectively, to sandwich the mattress cover body 20 therebetween. In this embodiment, the first, second, and third fasteners 50*a*, 50*b*, and 50*c* are in the form of a double-stitched thread, but in other embodiments, the fasteners 50 may be other types of fasteners commonly known in the art (e.g., plastic ties, a powerful adhesive, etc.).

Figure 3:
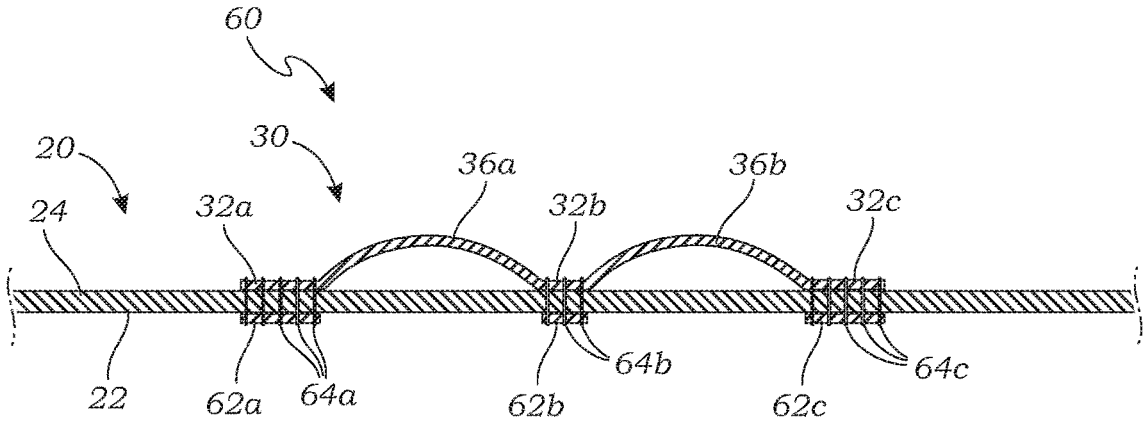
FIG. 3 is a sectional view similar to FIG. 2, illustrating a second embodiment of the invention.
Figure 4:
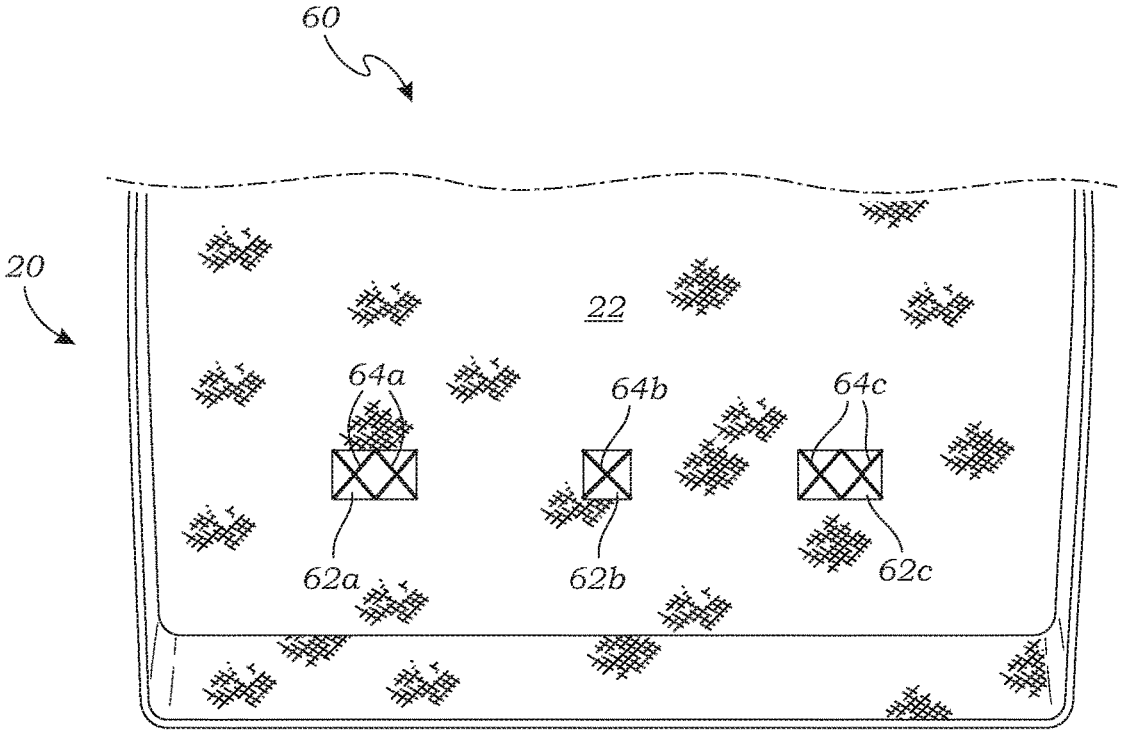
FIG. 4 is a bottom plan view of the mattress cover of FIG. 3.

FIG. 3 is a sectional view similar to FIG. 2, illustrating a second embodiment 60 of the invention, and FIG. 4 is a bottom plan view of the mattress cover 60 of FIG. 3. As shown in FIGS. 3-4, the mattress cover 60 is constructed the same as in the embodiment of FIGS. 1-2, but the first, second, and third attachment points 32*a*, 32*b*, and 32*c* of the handle strap 30 are instead fastened together with alternative first, second, and third attachment points 62*a*, 62*b*, and 62*c* located on the inner surface 22 of the mattress cover body 20. The first, second, and third attachment points 62*a*, 62*b*, and 62*c* of the inner surface 22 are in the form of patches of material that are not connected by handle portions. The patches of material 62*a*, 62*b*, and 62*c* are fastened together with fasteners 64*a*, 64*b*, and 64*c* to sandwich the rectangular cuboid mattress cover body 20 between the first, second, and third attachment points 32*a*, 32*b*, and 32*c* of the handle strap 30 and the first, second, and third attachment points 62*a*, 62*b*, and 62*c* of the inner surface 22, respectively. As described above, the fasteners 64 may be in the form of a double-stitched thread, but in other embodiments, the fasteners may be other types of fasteners commonly known in the art (e.g., plastic ties, a powerful adhesive, etc.).

As used in this application, the words "a," "an," and "one" are defined to include one or more of the referenced item unless specifically stated otherwise. The terms "approximately" and "about" are defined to mean +/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined by claims made to the invention.

What is claimed is:

1. A mattress cover for covering and carrying a mattress, the mattress cover comprising:

a rectangular cuboid mattress cover body adapted, sized, and shaped to fit around and contain the mattress, the cuboid mattress cover body having an inner surface and an outer surface;

a handle strap mounted on the outer surface of the rectangular cuboid mattress cover body for facilitating lifting of the mattress cover, the handle strap having first, second, and third attachment points, the first attachment point being at a first end of the handle strap, the second attachment point being at a middle of the handle strap, and the third attachment point being at a second end of the handle strap, thereby forming a first handle portion between the first and second attachment points, and forming a second handle portion between the second and third attachment points;

an additional handle strap mounted on the inner surface of the rectangular cuboid mattress cover body, the additional handle strap having first, second, and third attachment points, the first attachment point being at a first end of the additional handle strap, the second attachment point being at a middle of the additional handle strap, and the third attachment point being at a second end of the additional handle strap, thereby forming a first handle portion between the first and second attachment points, and forming a second handle portion between the second and third attachment points;

wherein the first attachment point of the handle strap and the first attachment point of the additional handle strap are fastened together with a first fastener to sandwich the rectangular cuboid mattress cover body therebetween;

wherein the second attachment point of the handle strap and the second attachment point of the additional handle strap are fastened together with a second fastener to sandwich the rectangular cuboid mattress cover body therebetween;

wherein the third attachment point of the handle strap and the third attachment point of the additional handle strap are fastened together with a third fastener to sandwich the rectangular cuboid mattress cover body therebetween; and wherein the first, second, and third fasteners are double-stitched thread.

* * * * *